US009384701B2

(12) United States Patent
Lee et al.

(10) Patent No.: US 9,384,701 B2
(45) Date of Patent: Jul. 5, 2016

(54) BACKLIGHT DRIVER WITH LUMINANCE CONTROL AND LIQUID CRYSTAL DISPLAY INCLUDING THE SAME

(71) Applicant: SAMSUNG DISPLAY CO., LTD., Yongin, Gyeonggi-Do (KR)

(72) Inventors: Ki-Chan Lee, Cheonan-Si (KR); Dong-Won Park, Cheonan-Si (KR); Hyun-Seok Ko, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/519,783

(22) Filed: Oct. 21, 2014

(65) Prior Publication Data

US 2015/0035877 A1 Feb. 5, 2015

Related U.S. Application Data

(62) Division of application No. 12/193,087, filed on Aug. 18, 2008, now Pat. No. 8,902,148.

(30) Foreign Application Priority Data

Sep. 28, 2007 (KR) ..... 10-2007-0098164

(51) Int. Cl.

| | |
|---|---|
| ***G09G 3/36*** | (2006.01) |
| ***G09G 3/34*** | (2006.01) |
| ***G09G 3/20*** | (2006.01) |

(52) U.S. Cl.

CPC ..... *G09G 3/342* (2013.01); *G09G 3/2088* (2013.01); *G09G 3/3648* (2013.01); *G09G 3/3611* (2013.01); *G09G 2310/024* (2013.01); *G09G 2320/064* (2013.01)

(58) Field of Classification Search

CPC G09G 3/342; G09G 3/3648; G09G 2320/064
USPC ..... 345/102
See application file for complete search history.

(56) References Cited

U.S. PATENT DOCUMENTS

| | | | |
|---|---|---|---|
| 6,771,281 | B2 | 8/2004 | Takagi |
| 6,816,142 | B2 | 11/2004 | Oda et al. |
| 7,009,440 | B2 | 3/2006 | Nogawa et al. |
| 7,023,232 | B2 | 4/2006 | Yano et al. |

(Continued)

FOREIGN PATENT DOCUMENTS

| | | |
|---|---|---|
| EP | 0 849 720 | 6/1998 |
| EP | 1694099 | 8/2006 |

(Continued)

OTHER PUBLICATIONS

European Search Report Dated Apr. 10, 2014.

(Continued)

*Primary Examiner* — Kwang-Su Yang
(74) *Attorney, Agent, or Firm* — F. Chau & Associates, LLC

(57) ABSTRACT

A backlight driver and a liquid crystal display (LCD) including the same, in which the backlight driver includes an interface unit enabled in response to a first carry signal, receiving serially provided optical data, and outputting a second carry signal; and a plurality of control units controlling one or more light-emitting devices in response to the serially provided optical data.

6 Claims, 15 Drawing Sheets

(56) References Cited

U.S. PATENT DOCUMENTS

| | | | | |
|---|---|---|---|---|
| 7,294,970 | B2 | 11/2007 | Yang | |
| 7,499,016 | B2 * | 3/2009 | Oh | G09G 3/3413 345/102 |
| 7,619,605 | B2 | 11/2009 | Shin et al. | |
| 7,800,566 | B2 | 9/2010 | Ha et al. | |
| 7,956,838 | B2 | 6/2011 | Mizumaki | |
| 7,986,294 | B2 | 7/2011 | Kojima | |
| 8,022,922 | B2 | 9/2011 | Kang | |
| 8,436,802 | B2 | 5/2013 | Yun | |
| 2004/0196049 | A1 | 10/2004 | Yano et al. | |
| 2004/0239668 | A1 | 12/2004 | Morosawa et al. | |
| 2005/0017778 | A1 * | 1/2005 | Nogawa | G09G 3/2014 327/165 |
| 2005/0083294 | A1 | 4/2005 | Kim et al. | |
| 2005/0184952 | A1 | 8/2005 | Konno et al. | |
| 2006/0022617 | A1 | 2/2006 | Liao et al. | |
| 2006/0186820 | A1 | 8/2006 | Yang | |
| 2006/0256099 | A1 | 11/2006 | Tashiro | |
| 2006/0279516 | A1 | 12/2006 | Yun | |
| 2006/0279517 | A1 | 12/2006 | Shin et al. | |
| 2007/0046485 | A1 | 3/2007 | Grootes et al. | |
| 2007/0132708 | A1 | 6/2007 | Pan et al. | |
| 2007/0176884 | A1 | 8/2007 | Takahashi | |
| 2007/0182698 | A1 | 8/2007 | Ha et al. | |
| 2007/0216638 | A1 | 9/2007 | Kojima | |
| 2008/0122762 | A1 | 5/2008 | Haung et al. | |
| 2009/0033611 | A1 | 2/2009 | Mizumaki | |
| 2010/0052544 | A1 * | 3/2010 | Park | H05B 41/3927 315/149 |
| 2011/0210674 | A1 | 9/2011 | Melanson | |

FOREIGN PATENT DOCUMENTS

| | | |
|---|---|---|
| JP | 09-026759 | 1/1997 |
| JP | 2004-361794 | 12/2004 |
| JP | 2005-135909 | 5/2005 |
| JP | 2005-345552 | 12/2005 |
| KR | 1020060084571 A | 7/2006 |
| KR | 10-2006-0128552 | 12/2006 |
| KR | 10-2006-0129663 | 12/2006 |
| KR | 10-0665369 | 1/2007 |
| WO | WO 2006/080254 | 8/2006 |
| WO | 2007/017795 A3 | 2/2007 |

OTHER PUBLICATIONS

Korean Notice of Allowance Dated Apr. 25, 2014.
English Abstract for Publication No. EP 0 849 720.
English Abstract for Publication No. WO 2006/080254.
European Office Action Dated May 24, 2013.
European Search Report dated Mar. 9, 2012 for Application No. 08 016 534.2.
Search Report issued by the EPO on Feb. 3, 2009 during the examination of the corresponding European Patent Application. (No. 08016534.3).

* cited by examiner

< t = t1 >

< t = t2 >

BACKLIGHT DRIVER WITH LUMINANCE CONTROL AND LIQUID CRYSTAL DISPLAY INCLUDING THE SAME

This application is a Divisional Application of U.S. patent application Ser. No. 12/193,087 filed on Aug. 18, 2008 which claims priority to and the benefit of Korean Patent Application No. 10-2007-0098164 filed on Sep. 28, 2007 in the Korean Intellectual Property Office, the entire disclosures of each of which are incorporated by reference herein.

BACKGROUND OF THE INVENTION

1. Technical Field

The present disclosure relates to a backlight driver and a liquid crystal display (LCD) including the same.

2. Discussion of Related Art

A conventional liquid crystal display (LCD) includes a first display substrate having a plurality of pixel electrodes, a second display substrate having a plurality of common electrodes, and a liquid crystal panel having a dielectrically anisotropic liquid crystal layer injected between the first and second display substrates. The LCD displays a desired image by forming an electric field between the pixel electrodes and the common electrodes that have a liquid crystal layer therebetween, adjusting the intensity of the electric field that aligns the liquid crystals, and thus controlling the amount of light being transmitted through the liquid crystal panel.

Because the LCD is not a self light-emitting display, it includes a plurality of light-emitting devices. As the number of light-emitting devices used in the LCD increases, the number of wires connected to the light-emitting devices is also increased.

SUMMARY OF THE INVENTION

Exemplary embodiments of the present invention provide a backlight driver that can reduce the number of wires utilized therein.

Exemplary embodiments of the present invention also provide a liquid crystal display (LCD) that can reduce the number of wires utilized therein.

The exemplary embodiments of the present invention are not restricted to the one set forth herein, however. The above and other exemplary embodiments of the present invention will become more apparent to one of ordinary skill in the art to which the present invention pertains by referencing the detailed description of the exemplary embodiments of the present invention given below.

According to an exemplary embodiment of the present invention, there is provided a backlight driver including an interface unit enabled in response to a first carry signal, receiving optical data serially provided, and outputting a second carry signal; and a plurality of control units controlling one or more light-emitting devices in response to the optical data.

According to an exemplary embodiment of the present invention, there is provided an LCD including a timing controller serially providing optical data; first through n-th backlight drivers enabled sequentially, receiving the optical data, and connected to each other in a cascade; a plurality of light-emitting devices connected to each of the first through n-th backlight drivers and emitting light in response to the optical data; and a liquid crystal panel receiving the light and displaying an image.

According to an exemplary embodiment of the present invention, there is provided an LCD including a timing controller; first through n-th backlight drivers serially interfacing with the timing controller; a plurality of light-emitting blocks corresponding to each of the first through n-th backlight drivers, each light-emitting block including one or more light-emitting devices; and a liquid crystal panel receiving light from the light-emitting blocks and displaying an image, wherein each of the first through n-th backlight drivers controls the luminances of the corresponding light-emitting blocks.

BRIEF DESCRIPTION OF THE DRAWINGS

Exemplary embodiments of the present invention will be understood in more detail from the following descriptions taken in conjunction with the attached drawings, in which.

DETAILED DESCRIPTION OF EXEMPLARY EMBODIMENTS

Figure 1:
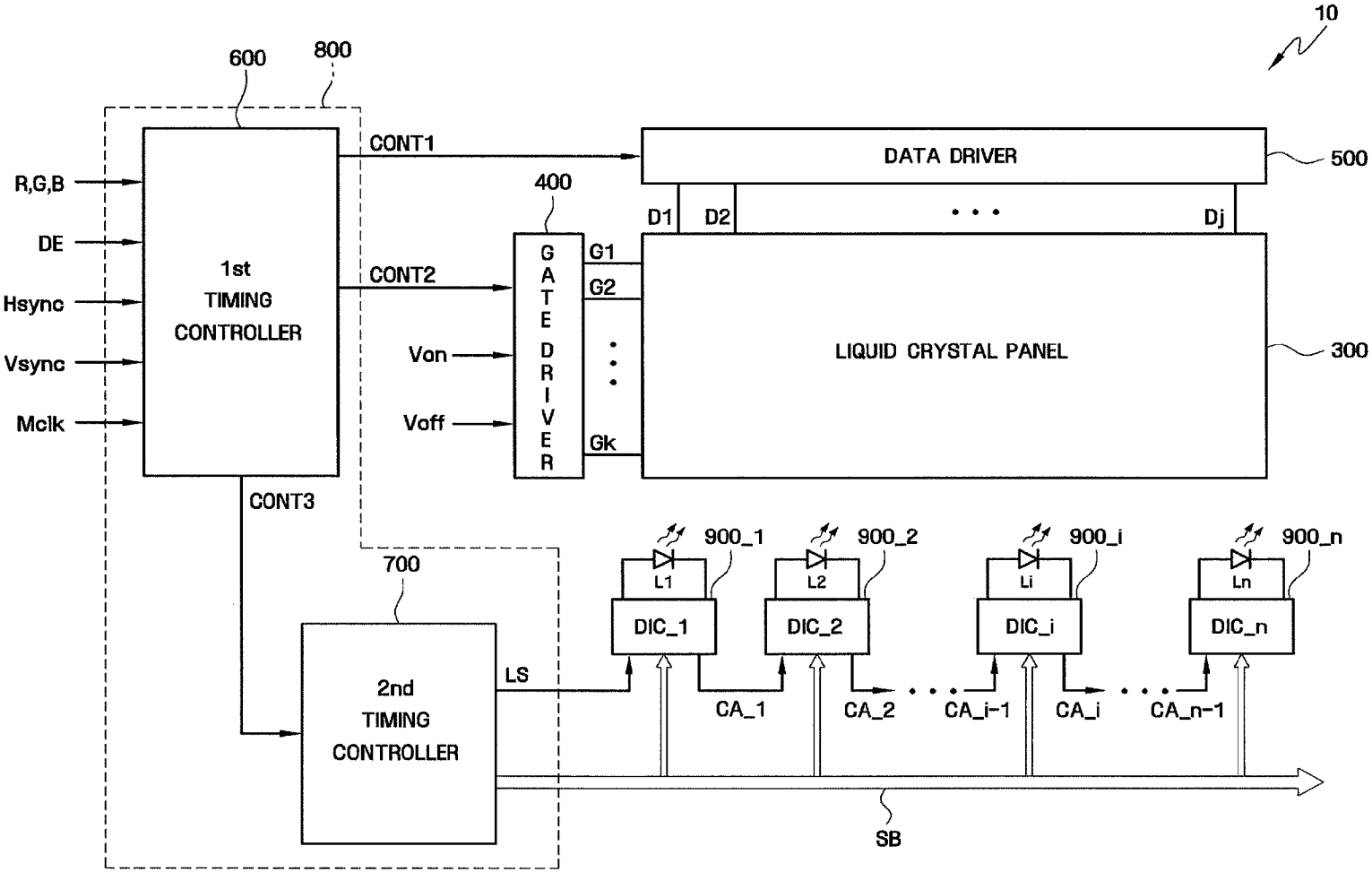
FIG. 1 is a block diagram of a liquid crystal display (LCD) according to an exemplary embodiment of the present invention.

Exemplary embodiments of the present invention will now be described more fully with reference to the accompanying drawings, in which exemplary embodiments of the invention are shown. The invention may, however, be embodied in many different forms and should not be construed as being limited to the exemplary embodiments set forth herein; rather, these exemplary embodiments are provided so that this disclosure will be thorough and complete, and will fully convey the concept of the invention to those of ordinary skill in the art. Like reference numerals in the drawings denote like elements, and thus their duplicate description will be omitted.

Figure 2:
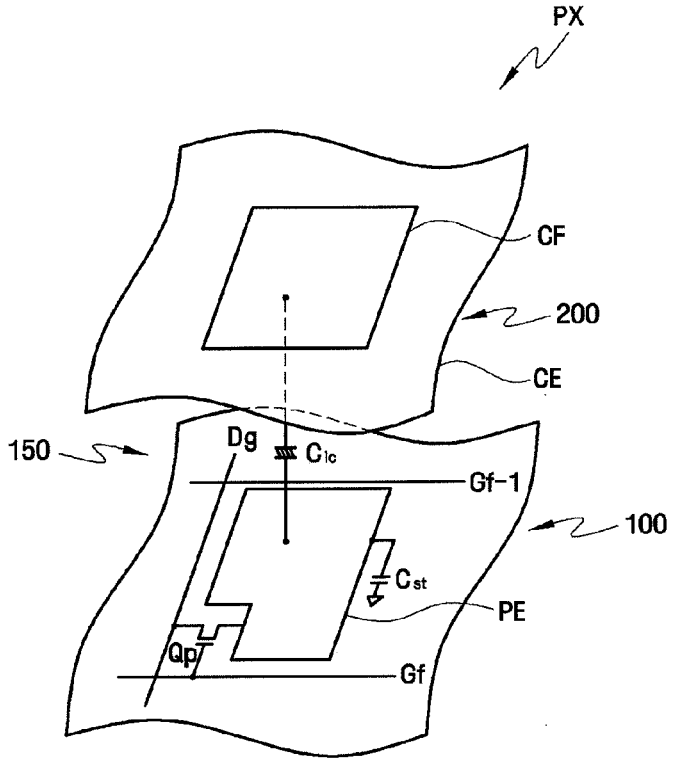
FIG. 2 is an equivalent circuit diagram of a pixel included in the LCD of FIG. 1.
Figure 3:
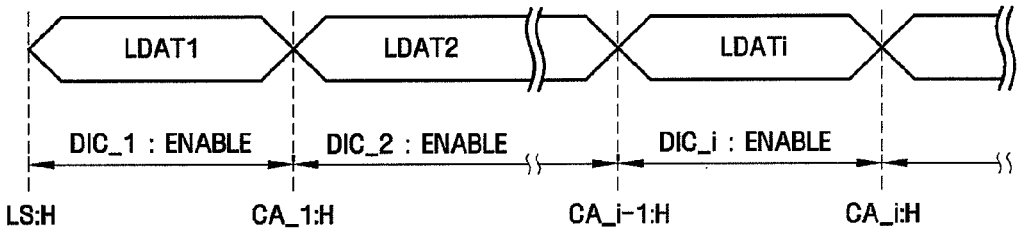
FIG. 3 is a conceptual diagram useful for explaining the operations of first through $n^{th}$ backlight drivers illustrated in FIG. 1.
Figure 4:
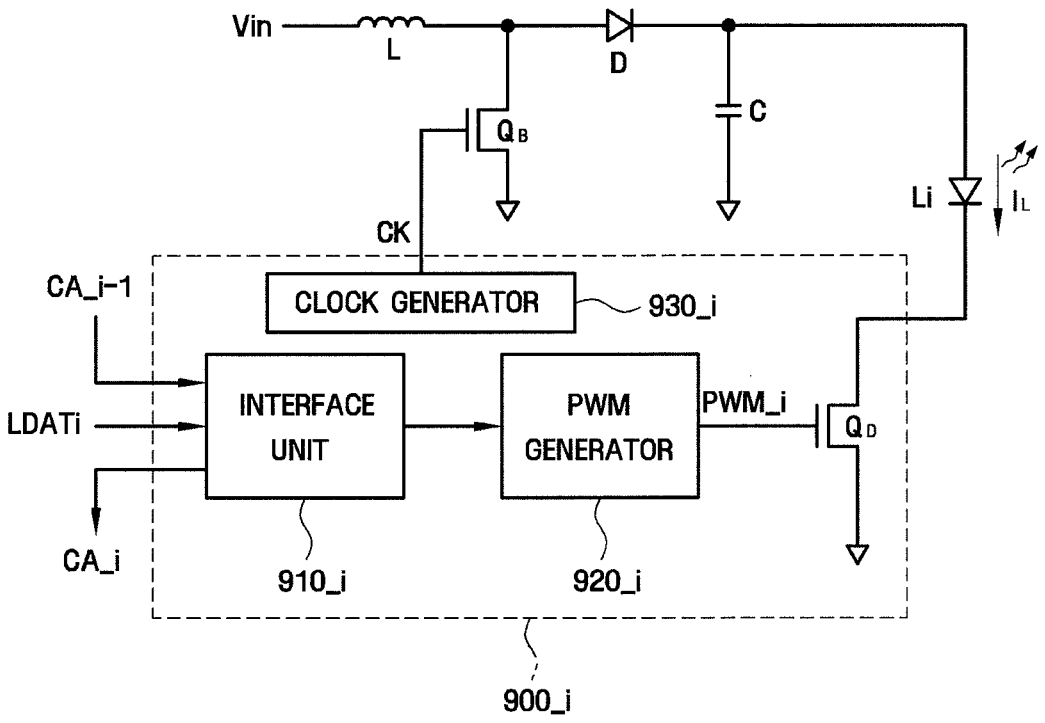
FIG. 4 is a block diagram of an $i^{th}$ backlight driver illustrated in FIG. 1.

Hereinafter, a backlight driver and a liquid crystal display (LCD) including the same according to an exemplary embodiment of the present invention will be described with reference to FIGS. 1 through 4. FIG. 1 is a block diagram of an LCD 10 according to an exemplary embodiment of the present invention. FIG. 2 is an equivalent circuit diagram of a pixel PX included in the LCD 10 of FIG. 1. FIG. 3 is a conceptual diagram for explaining the operations of first through $n^{th}$ backlight drivers 900_1 through **900_*n* illustrated in FIG. 1. FIG. 4 is a block diagram of an $i^{th}$ backlight driver 900_*i* illustrated in FIG. 1**.

Referring to FIG. 1, the LCD 10 includes a liquid crystal panel 300, a gate driver 400, a data driver 500, a timing controller 800, the first through $n^{th}$ backlight drivers 900_1 through **900_*n*, and a plurality of light-emitting devices L1 through Ln connected to the first through $n^{th}$ backlight drivers 900_1 through 900_*n*, respectively. The timing controller 800 may functionally be divided into a first timing controller 600 and a second timing controller 700. The first timing controller 600 may control an image displayed on the liquid crystal panel 300, and the second timing controller 700 may control the first through $n^{th}$ backlight drivers 900_1 through 900_*n*. The first timing controller 600 and the second timing controller 700 need not be physically separated from each other as shown in FIG. 1**.

An equivalent circuit of the liquid crystal panel 300 includes a plurality of display signal lines and a plurality of pixels (not shown) connected to the display signal lines, respectively. The signal lines include a plurality of gate lines G1 through Gk and a plurality of data lines D1 through Dj.

As described above, the liquid crystal panel 300 includes a plurality of pixels, and an equivalent circuit of one of the pixels included in the liquid crystal panel 300 is illustrated in FIG. 2. Referring to FIG. 2, a pixel PX connected to, for example, an $f^{th}$ (f=1~i) gate line Gf and a $g^{th}$ (g=1~j) data line Dg includes a switching device Qp connected to the $f^{th}$ gate line Gf and the $g^{th}$ data line Dg and a liquid crystal capacitor Clc and a storage capacitor Cst connected to the switching device Qp. The liquid crystal capacitor Clc includes a pixel electrode PE of a first display substrate 100 and a common electrode CE of a second display substrate 200. In addition, a color filter CF is formed on a portion of the common electrode CE.

The data driver 500 of FIG. 1 receives a data control signal CONT1 from the first timing controller 600 and applies an image data voltage to the data lines D1 through Dj. The data control signal CONT1 includes image signals corresponding to red (R), green (G) and blue (B) signals R, G, and B and signals for controlling the operation of the data driver 500. The signals for controlling the operation of the data driver 500 may include a horizontal start signal for initiating the operation of the data driver 500 and an output command signal for instructing the output of the image data voltage.

The gate driver 400 receives a gate control signal CONT2 from the first timing controller 600 and transmits a gate signal to the gate lines G1 through Gk. The gate signal includes a gate-on voltage Von and a gate-off voltage Voff provided by a gate-on/off voltage generator (not shown). The gate control signal CONT2 is used to control the operation of the gate driver 400 and may include a vertical start signal for initiating the operation of the gate driver 400, a gate clock signal for determining an output time of the gate-on voltage Von, and an output enable signal for determining a pulse width of the gate-on voltage Von.

The gate driver 400 or the data driver 500 may be mounted directly on the liquid crystal panel 300 in the form of a plurality of driving integrated circuit chips. Alternatively, the gate driver 400 or the data driver 500 may be mounted on a flexible printed circuit film (not shown) and then attached to the liquid crystal panel 300 in the form of a tape carrier package. Alternatively, the gate driver 400 or the data driver 500 may be integrated into the liquid crystal panel 300, together with the display signal lines, that is, the gate lines G1 through Gk and the data lines D1 through Dj, and the switching device Qp.

The first timing controller 600 receives the R, G, and B signals and a plurality of control signals for controlling the display of the R, G, and B signals from an external graphic controller (not shown). Then, the first timing controller 600 generates the data control signal CONT1 and the gate control signal CONT2 based on the R, G, and B signals and the control signals. The control signals include a vertical synchronization signal Vsync, a horizontal synchronization signal Hsync, a main clock Mclk, and a data enable signal DE. The first timing controller 600 transmits a backlight control signal CONT3 to the second timing controller 700. The backlight control signal CONT3 may include optical data. The optical data is used to control the luminance of each of the light-emitting devices L1 through Ln.

The second timing controller 700 receives the backlight control signal CONT3 from the first timing controller 600 and serially provides the optical data to the first through $n^{th}$ backlight drivers 900_1 through **900_*n*. In this exemplary embodiment, the optical data may be provided through a serial bus SB. In addition, the second timing controller 700 transmits a start signal LS to the first backlight driver 900_1**.

The first through $n^{th}$ backlight drivers 900_1 through **900_*n* are connected to each other in cascade and, thus, are sequentially enabled. In addition, the first through $n^{th}$ backlight drivers 900_1 through 900_*n* receive the serially provided optical data. Referring to FIGS. 1 and 3, the second timing controller 700 serially transmits optical data LDAT1 through LDATi and, at the same time, transmits the start signal LS in a high level. Accordingly, the first backlight driver 900_1 is enabled in response to the start signal LS in the high level and receives the serially provided optical data LDAT1. In this exemplary embodiment, the second through $n^{th}$ backlight drivers 900_2 through 900_*n* do not receive the optical data LDAT1. After receiving the optical data LDAT1 corresponding to the first backlight driver 900_1, the first backlight driver 900_1 outputs a first carry signal CA_1 in a high level. At this time, the start signal LS may transit to a low level. If the start signal LS transits to a low level, the first backlight driver 900_1 does not receive the optical data LDAT2 through LDATi. Next, the second backlight driver 900_2 is enabled in response to the first carry signal CA_1 in the high level, receives the optical data LDAT2 corresponding to the second backlight driver 9002, and outputs a second carry signal CA_2 in a high level. The $i^{th}$ backlight driver 900_*i* is enabled in response to a $(i-1)^{th}$ carry signal CA_i−1 in a high level, receives the optical data LDATi corresponding to the backlight driver 900_*i***, and outputs an carry signal CA_i in a high level.

The first through $n^{th}$ backlight drivers 900_1 through **900_*n* control the luminances of the light-emitting devices L1 through Ln in response to the optical data LDAT1 through LDATi, respectively. The first through $n^{th}$ backlight drivers 900_1 through 900_*n* will now be described in more detail using the backlight driver 900_*i* as an example and with reference to FIGS. 3 and 4**. In this exemplary embodiment, a case where a boost converter provides a power supply voltage required to drive the light-emitting devices L1 through Ln will be described as an example. The present invention, however, is not limited thereto.

Referring to FIG. 4, the backlight driver 900_*i* includes an interface unit 910_*i* and a control unit that may include a pulse width modulation (PWM) generator 920_*i* and a switching device $Q_D$.

The interface unit 910_*i* that is enabled in response to the $(i-1)^{th}$ carry signal CA_i−1, receives the optical data LDATi corresponding to the $i^{th}$ backlight driver 900_*i*, and outputs the $i^{th}$ carry signal CA_i. For example, the interface unit 910_*i* is enabled in response to the $(i-1)^{th}$ carry signal CA_i−1 in a high level and is disabled after outputting the carry signal CA_i in a high level.

As described above, the control unit includes the PWM generator 920_*i* and the switching device $Q_D$. The control unit controls the luminance of the light-emitting device Li in response to the optical data LDATi corresponding to the backlight driver 900_*i*.

The PWM generator 920_*i* outputs a PWM signal PWM_i whose duty ratio is adjusted in response to the optical data LDATi. The switching device $Q_D$ is turned on or off in response to the PWM signal PWM_i, thereby connecting or disconnecting the light-emitting device Li to/from a ground node. For example, the switching device $Q_D$ is turned on in a section in which the PWM signal PWM_i is in a high level and connects the light-emitting device Li to the ground node. In this exemplary embodiment, a current $I_L$ flows through the light-emitting device Li, and thus the light-emitting device Li emits light. In addition, the switching device $Q_D$ is turned off in a section in which the PWM signal PWM_i is in a low level and disconnects the light-emitting device Li from the ground node. In this exemplary embodiment, the current $I_L$ does not flow through the light-emitting device Li, and thus the light-emitting device Li is turned off. A period of time during which the light-emitting device Li is turned on is determined by the section in which the PWM signal PWM_i is in a high level and the section in which the PWM signal PWM_i is in a low level. If the period of time during which the light-emitting device Li is turned on increases, the luminance of the light-emitting device Li is increased. In summary, the duty ratio of the PWM signal PWM_i is adjusted according to the optical data LDATi, and the luminance of the light-emitting device Li is adjusted according to the duty ratio of the PWM signal PWM_i. The control unit may control the luminance of the light-emitting device Li by adjusting the amount of current that flows through the light-emitting device Li, as well as by turning on or off the light-emitting device Li as described above.

The boost converter includes an inductor L, a diode D, a capacitor C, a switching device $Q_B$, and a clock generator 930_*i*. The boost converter boosts an input voltage Vin in response to a clock signal CK and provides a power supply voltage required to operate the light-emitting device Li. The clock generator 930_*i* may be implemented within the $i^{th}$ backlight driver 900_*i*. The boost converter is a well-known boosting circuit, and thus a detailed description thereof will be omitted for the sake of simplicity.

In the first through $n^{th}$ backlight drivers 900_1 through 900_*n* and the LCD 10 including the same, the timing controller 800 serially transmits the optical data LDAT1 through LDATi to the first through $n^{th}$ backlight drivers 900_1 through 900_*n* through the serial bus SB. Therefore, the number of wires between the timing controller 800 and the first through $n^{th}$ backlight drivers 900_1 through 900_*n* can be reduced. If the number of wires is reduced, manufacturing costs can be reduced, and problems caused by short circuits and disconnections of wires can be reduced.

Figure 5:
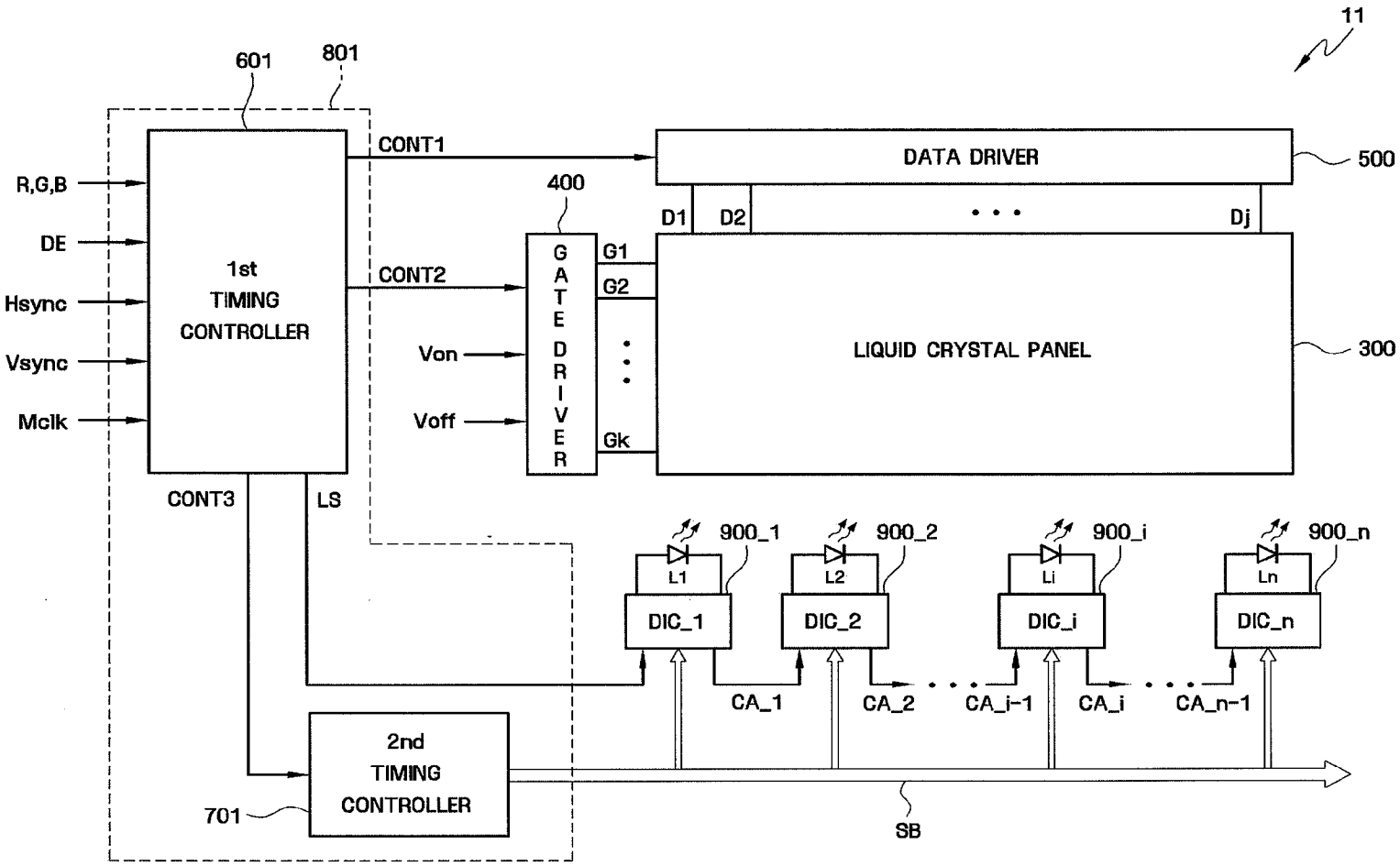
FIG. 5 is a block diagram of an LCD according to an exemplary embodiment of the present invention.

Hereinafter, an LCD according to an exemplary embodiment of the present invention will be described with reference to FIG. 5. FIG. 5 is a block diagram of an LCD 11 according to an exemplary embodiment of the present invention. Elements having the same functions as those illustrated in FIG. 1 are indicated by like reference numerals, and thus their description will be omitted.

Referring to FIG. 5, unlike what is described in relation to the initially described exemplary embodiment, in the present exemplary embodiment, a first timing controller 601 of the LCD 11 transmits a start signal LS to a first backlight driver 900_1. In this case, the start signal LS may be one of a data control signal CONT1 and a gate control signal CONT2. For example, the start signal LS may be any one of a vertical start signal for initiating the operation of the gate driver 400 of FIG. 1, a gate clock signal for determining an output time of a gate-on voltage Von, an output enable signal for determining a pulse width of the gate-on voltage Von, a horizontal start signal for initiating the operation of the data driver 500 as shown in FIG. 1 and an output command signal for instructing the output of an image data voltage. Alternatively, the start signal LS may be a signal synchronized with any one of the above-described signals or may be a combination of these signals. Alternatively, the start signal LS may be any one of a vertical synchronization signal Vsync, a horizontal synchronization signal Hsync, a main clock Mclk and a data enable signal DE, may be a signal synchronized with any one of the same, or may be a combination of the same.

Figure 6:
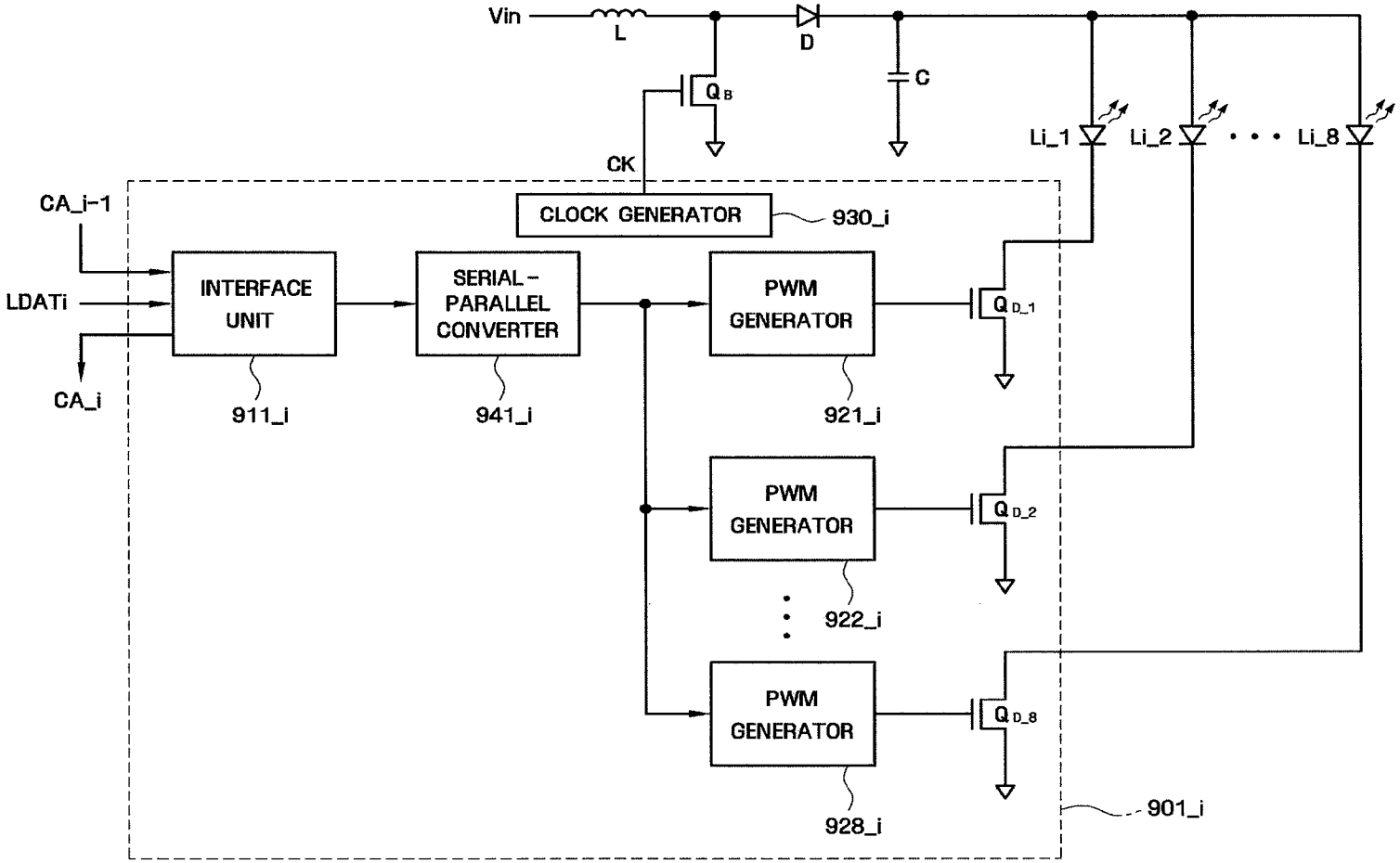
FIG. 6 is a block diagram of an LCD including an $i^{th}$ backlight driver according to an exemplary embodiment of the present invention.
Figure 7:
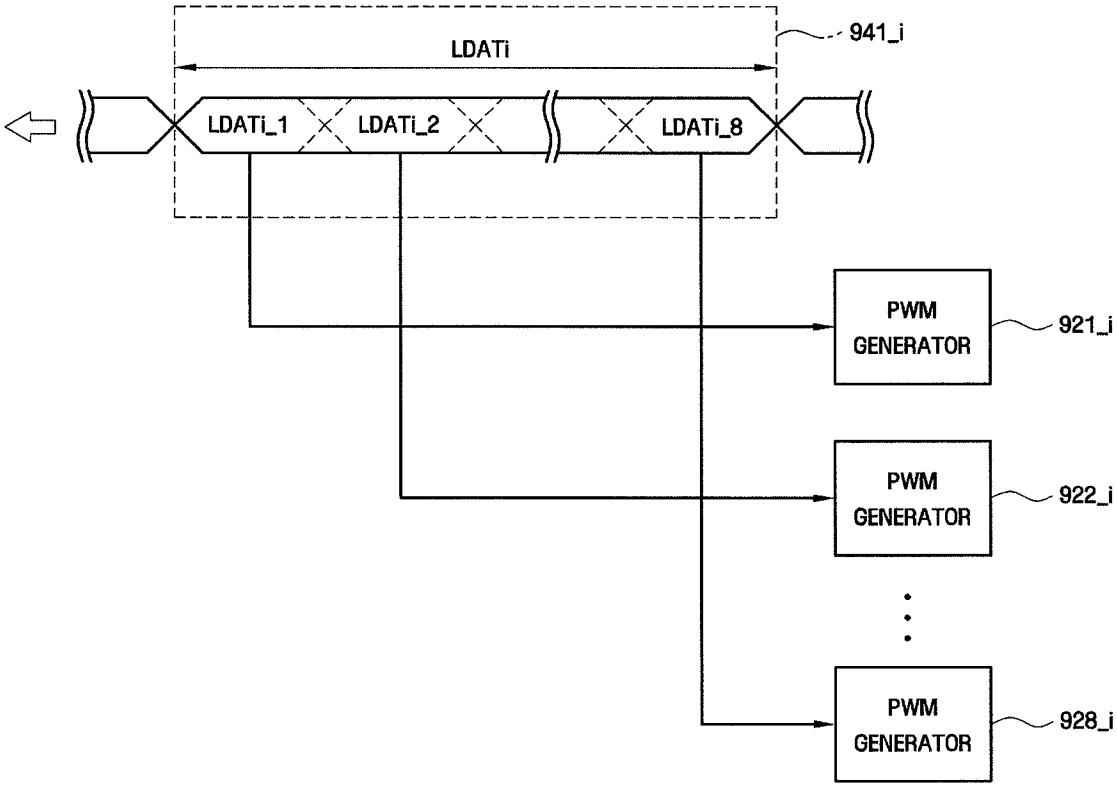
FIG. 7 is a conceptual diagram useful for explaining the operation of a serial-parallel converter illustrated in FIG. 6.

A backlight driver and an LCD including the same according to an exemplary embodiment of the present invention will now be described with reference to FIGS. 6 and 7. FIG. 6 is a block diagram of an LCD including an $i^{th}$ backlight driver 901_*i* according to an exemplary embodiment of the present invention. FIG. 7 is a conceptual diagram for explaining the operation of a serial-parallel converter 941_*i* illustrated in FIG. 6. Elements having the same functions as those illustrated in FIG. 4 are indicated by like reference numerals, and thus their description will be omitted.

Referring to FIG. 6, unlike what is described in relation to the previous exemplary embodiment, in the present exemplary embodiment, each backlight driver, for example, the $i^{th}$ backlight driver 901_*i*, controls a plurality of, for example, eight light-emitting devices Li_1 through Li_8. In order to control the light-emitting devices Li_1 through Li_8, the $i^{th}$ backlight driver 901_*i* includes the serial-parallel converter 941_*i* and a plurality of control units. The control units include a plurality of PWM generators 921_*i* through 928_*i* and a plurality of switching devices $Q_{D_1}$ through $Q_{D_8}$, respectively.

More specifically, referring to FIGS. 6 and 7, an interface unit 911_*i* is enabled in response to a $(i-1)^{th}$ carry signal CA_i−1 and receives optical data LDATi that is serially provided. Then, the interface unit 911_*i* outputs an $i^{th}$ carry signal CA_i. The serial-parallel converter 941_*i* converts the serially input optical data LDATi into parallel optical data. For example, if the $i^{th}$ backlight driver 900_*i* controls the eight light-emitting devices Li_1 through Li_8 individually, the optical data LDATi corresponding to the backlight driver 900_*i* includes eight pieces of sub optical data LDATi_1 through LDATi_8. The serial-parallel converter 941_*i* provides the sub optical data LDATi_1 through LDATi_8 in parallel to the PWM generators 921_*i* through 928_*i*, respectively.

As described above, the control units include the PWM generators 921_*i* through 928_*i* and the respective switching devices $Q_{D_1}$ through $Q_{D_8}$ and control the respective luminances of the light-emitting devices Li_1 through Li_8, respectively, in response to the parallel optical data.

Figure 8:
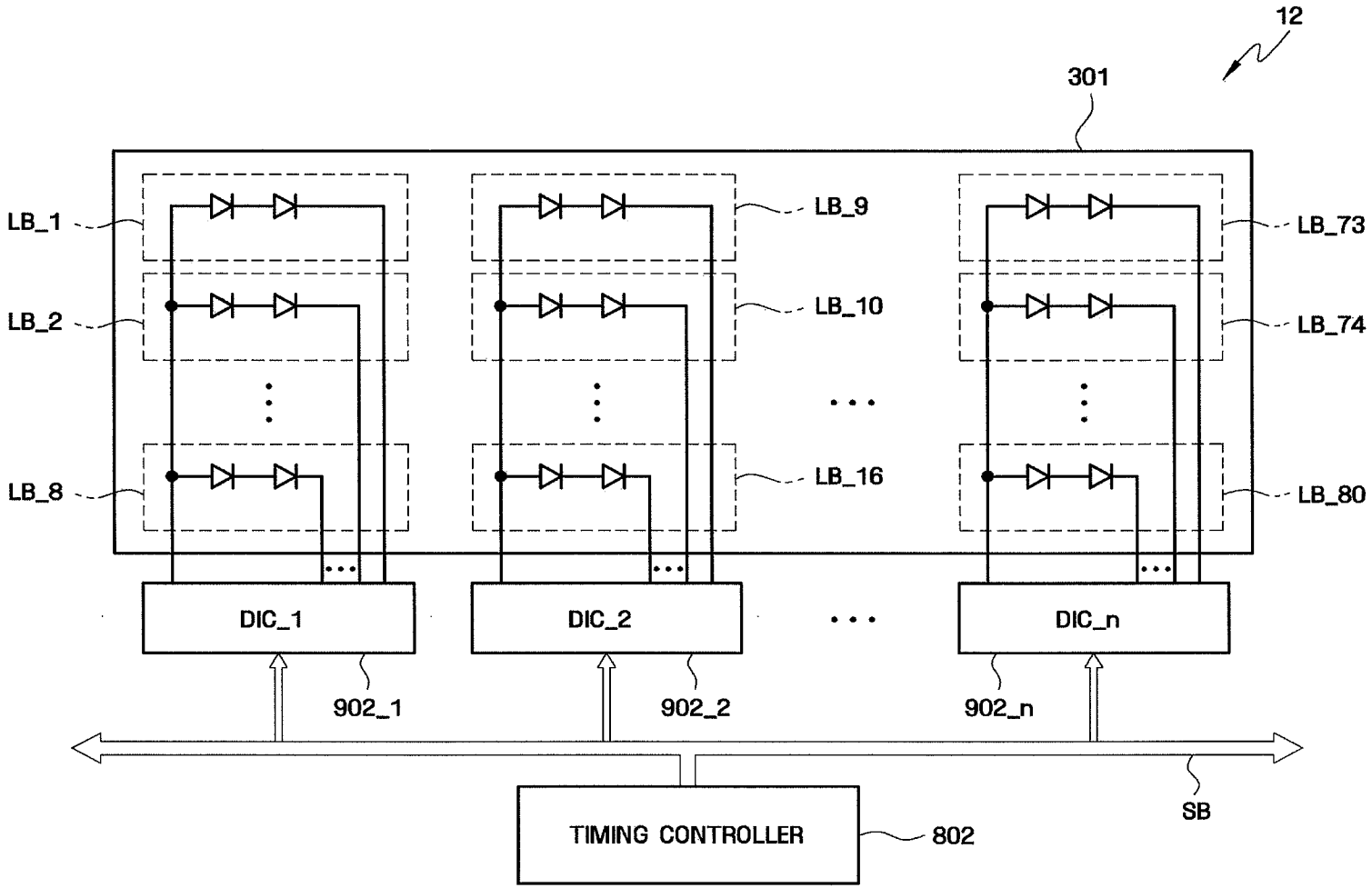
FIG. 8 is a block diagram of an LCD including first through $n^{th}$ backlight drivers according to an exemplary embodiment of the present invention.
Figure 9:
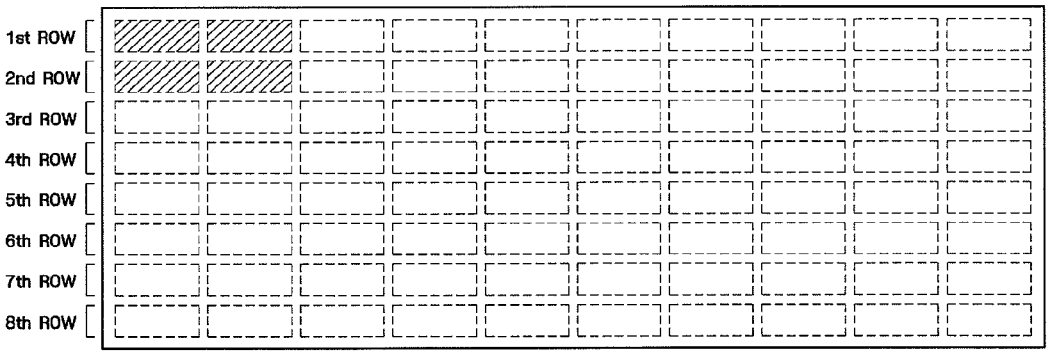
FIGS. 9 through 10D are conceptual diagrams useful for explaining the operations of first through eightieth light-emitting blocks illustrated in FIG. 8.
Figure 10A:
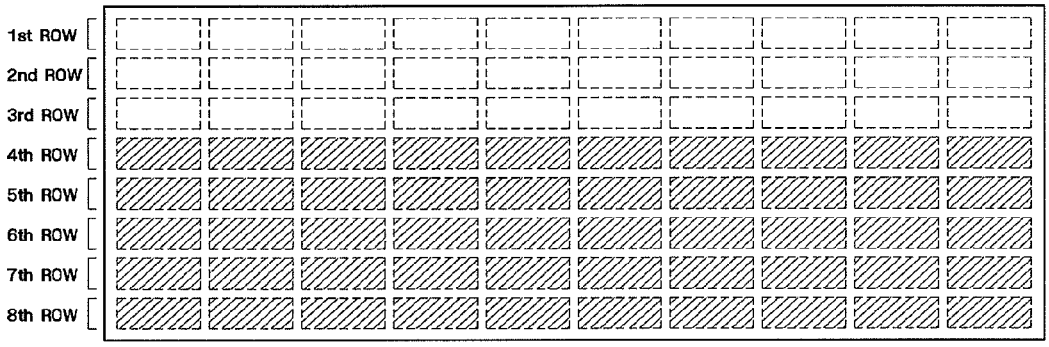
Figure 10B:
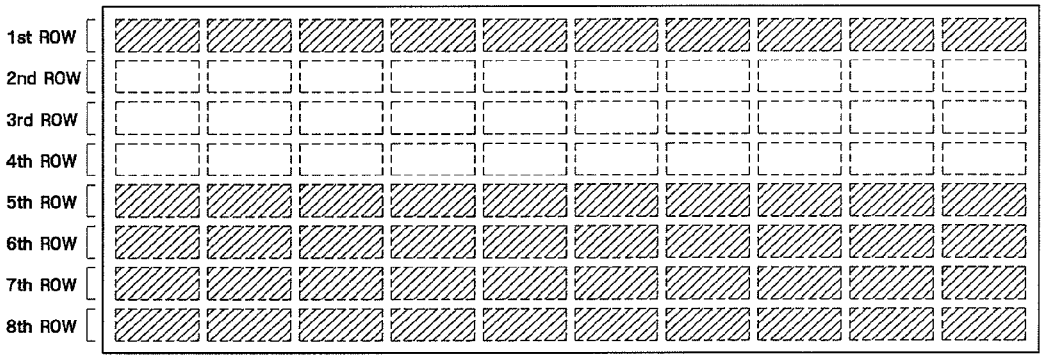
Figure 10C:
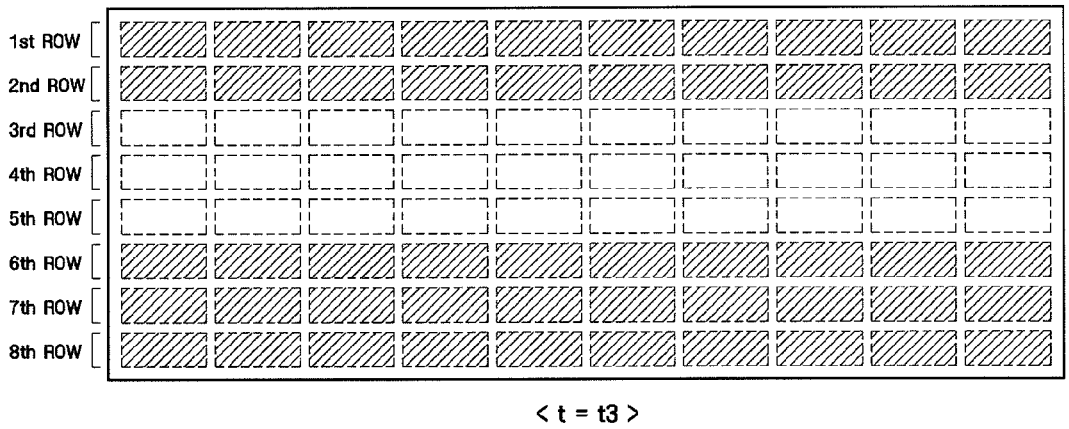
Figure 10D:
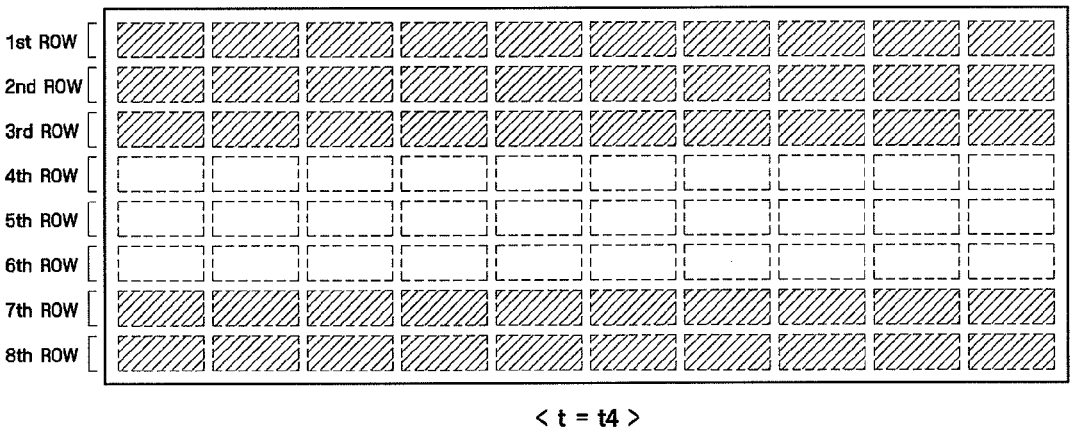

A backlight driver and an LCD including the same according to an exemplary embodiment of the present invention will now be described with reference to FIGS. 8 through 10D. FIG. 8 is a block diagram of an LCD 12 including first through $n^{th}$ backlight drivers 902_1 through **902_*n* according to an exemplary embodiment of the present invention. FIGS. 9 through 10D are conceptual diagrams for explaining the operations of first through eightieth light-emitting blocks LB_1 through LB_80 illustrated in FIG. 8. Elements having the same functions as those illustrated in FIG. 1** are indicated by like reference numerals, and thus their description will be omitted.

Referring to FIG. 8, the LCD 12 includes a timing controller 802, the first through $n^{th}$ backlight drivers 902_1 through **902_*n*, and a plurality of, for example, the first through eightieth, light-emitting blocks LB_1 through LB_80. Each of the first through eightieth light-emitting blocks LB_1 through LB_80** includes at least one light-emitting device.

The timing controller 802 serially interfaces with each of the first through $n^{th}$ backlight drivers 902_1 through **902_*n*. In this case, the timing controller 802 may serially interface with each of the first through $n^{th}$ backlight drivers 902_1 through 902_*n*** using a serial bus SB.

If the timing controller 802 serially provides optical data to the first through $n^{th}$ backlight drivers 902_1 through **902_*n* through the serial bus SB, each of the first through $n^{th}$ backlight drivers 902_1 through 902_*n* may be enabled in response to a carry signal and receive its corresponding optical data as described above. Alternatively, if each of the first through $n^{th}$ backlight drivers 902_1 through 902_*n* has a unique address, the timing controller 802 may serially provide an address signal and optical data corresponding to each of the first through $n^{th}$ backlight drivers 902_1 through 902_*n* to each of the first through $n^{th}$ backlight drivers 902_1 through 902_*n* through the serial bus SB. Then, each of the first through $n^{th}$ backlight drivers 902_1 through 902_*n* may be enabled in response to the address signal and can receive the optical data. In this case, the timing controller 802 can use various methods other than the above methods in order to provide the optical data to each of the first through $n^{th}$ backlight drivers 902_1 through 902_*n*** through the serial bus SB.

Eight of the first through eightieth light-emitting blocks LB_1 through LB_80 correspond to each of the first through $n^{th}$ backlight drivers 902_1 through **902_*n*. For example, the first through eighth light-emitting blocks LB_1 through LB_8 correspond to the first backlight driver 900_1, and the ninth through sixteenth light-emitting blocks LB_9 through LB_16 correspond to the second backlight driver 9002. That is, the first backlight driver 900_1 controls the first through eighth light-emitting blocks LB_1 through LB_80, and the second backlight driver 900_2 controls the ninth through sixteenth light-emitting blocks LB_9 through LB_16. The first through eightieth light-emitting blocks LB_1 through LB_80 may be arranged in a matrix. For example, the first through eightieth light-emitting blocks LB_1 through LB_80 may be arranged in a matrix with eight rows and ten columns (n=10). The first through eightieth light-emitting blocks LB_1 through LB_80 may be implemented in a region 301 facing the liquid crystal panel 300 illustrated in FIG. 1 and emit light to the liquid crystal panel 300**.

Each of the first through $n^{th}$ backlight drivers 902_1 through **902_*n* controls the luminances of eight corresponding ones of the first through eightieth light-emitting blocks LB_1 through LB_80. More specifically, referring to FIGS. 8 and 9, the first backlight driver as shown at 900_1 in FIG. 1 may reduce the luminances of the first and second light-emitting blocks LB_1 and LB_2 in first and second rows 1st ROW and 2nd ROW of a first column of an 8×10 matrix shown in FIG. 9 and increase the luminances of the third through eighth light-emitting blocks LB_3 through LB_8 in third through eighth rows 3rd ROW through 8th ROW in the first column. The second backlight driver 900_2 may reduce the luminances of the ninth and tenth light-emitting blocks LB_9 and LB 10 in the first and second rows 1st ROW and 2nd ROW of a second column of the 8×10 matrix and increase the luminances of the eleventh through sixteenth light-emitting blocks LB_11 through LB_16 in the third through eighth rows 3rd ROW through 8th ROW in the second column. The third through $n^{th}$ backlight drivers 902_3 through 902_*n* may increase the luminances of the seventeenth through eightieth light-emitting blocks LB_1 through LB_80 in the first through eighth rows 1st ROW through 8th ROW of third through tenth columns, respectively. That is, each of the first through $n^{th}$ backlight drivers 902_1 through 902_*n* can control the luminances of eight corresponding ones of the first through eightieth light-emitting blocks LB_1 through LB_80 according to an image displayed on a liquid crystal panel 300. If the luminance of each of the first through eightieth light-emitting blocks LB_1 through LB_80 is controlled according to an image displayed on the liquid crystal panel 300**, power consumption can be reduced.

Alternatively, the first through $n^{th}$ backlight drivers 902_1 through **902_*n* may control the first through eightieth light-emitting blocks LB_1 through LB_80 to be turned on or off in units of rows. More specifically, referring to FIGS. 8 and 10A through 10D, at a time t1, light-emitting blocks in the first through third rows 1st ROW through 3rd ROW of the 8×10 matrix may be turned on, and those in the fourth through eighth rows 4th ROW through 8th ROW may be turned off. At a time t2, light-emitting blocks in the second through fourth rows 2nd ROW through 4th ROW may be turned on, and those in the first row 1st ROW and the fifth through eighth rows 5th ROW through 8th ROW may be turned off. At a time t3, light-emitting blocks in the third through fifth rows 3rd ROW through 5th ROW may be turned on, and those in the first row 1st ROW, the second row 2nd ROW and the sixth through eighth rows 6th ROW through 8th ROW may be turned off. At a time t4, light-emitting blocks in the fourth through sixth rows 4th ROW through 6th ROW may be turned on, and those in the first through third rows 1st ROW through 3rd ROW, the seventh row 7th ROW and the eighth row 8th ROW may be turned off. In this way, the first through eightieth light-emitting blocks LB_1 through LB_80 may be sequentially turned or off in units of rows. If each of the first through eightieth light-emitting blocks LB_1 through LB_80 is turned off according to time, the effect of inserting a black image between images displayed on the liquid crystal panel 300** may be produced. Therefore, when a moving image is displayed, superior display quality, like that which can be experienced in cathode ray tubes (CRTs), can be obtained.

Backlight drivers controlling the operations of light-emitting blocks and an LCD including the same will further be described below in each exemplary embodiment of the present invention.

Figure 11:
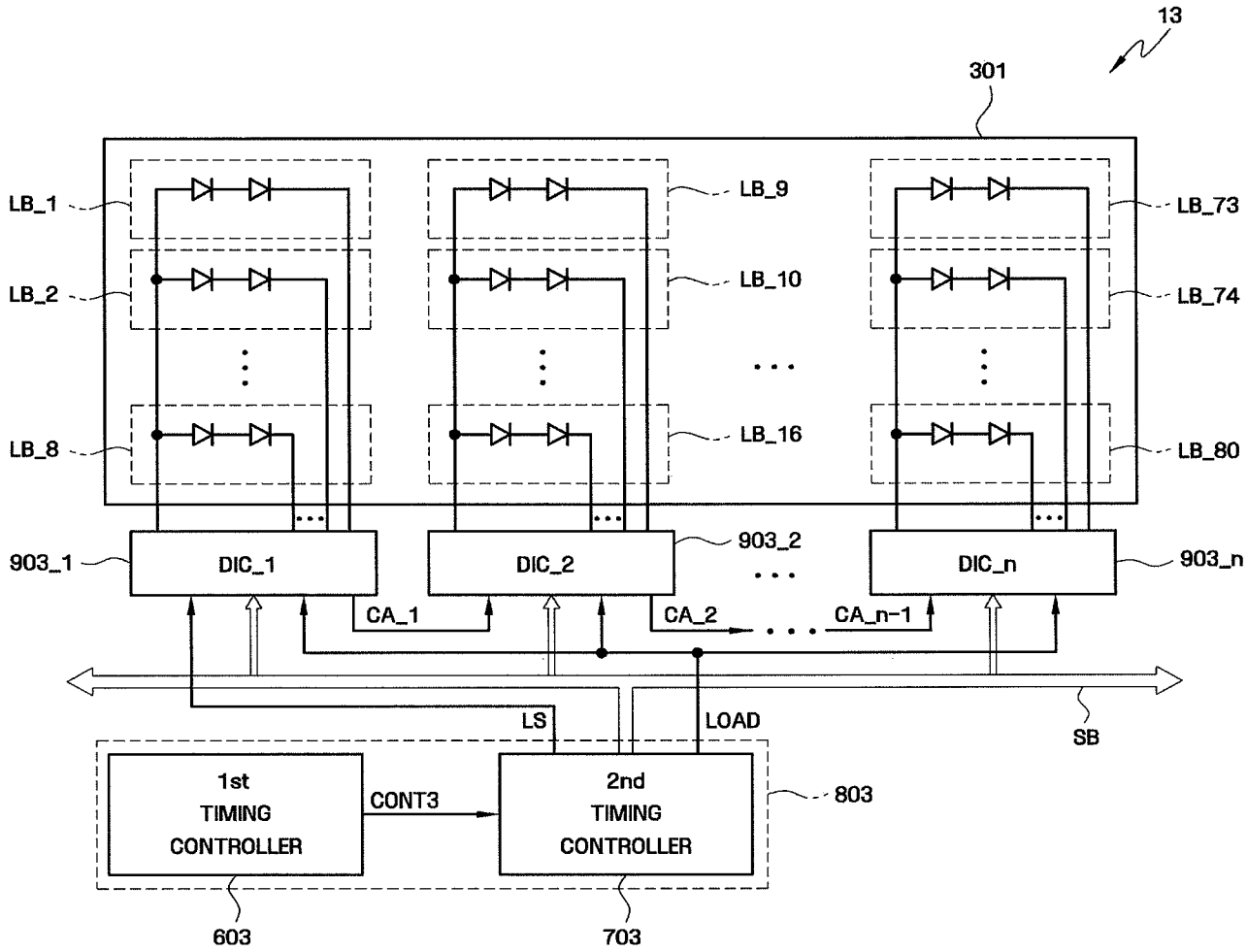
FIG. 11 is a block diagram of an LCD including first through $n^{th}$ backlight drivers according to an exemplary embodiment of the present invention.
Figure 12:
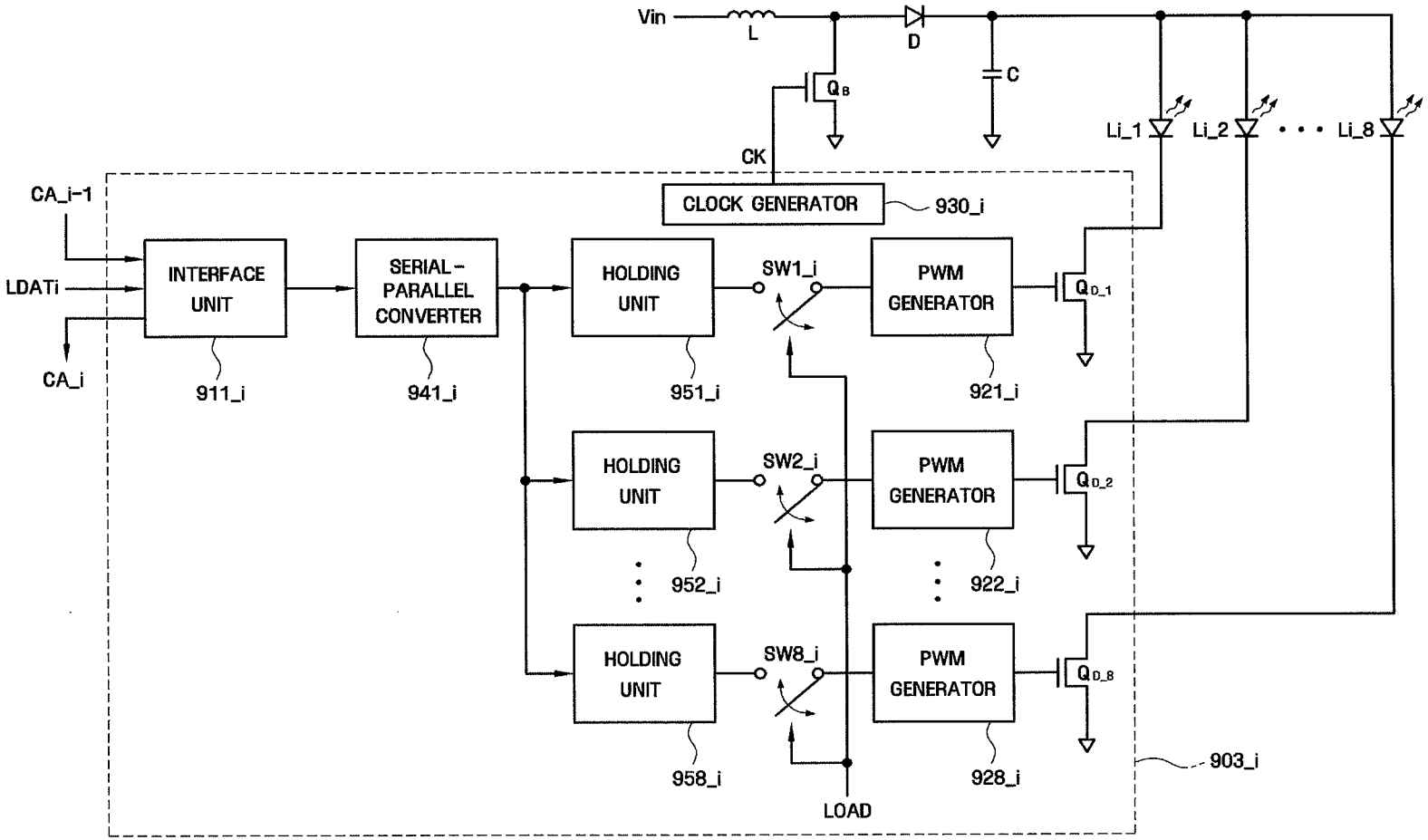
FIG. 12 is a block diagram of an $i^{th}$ backlight driver illustrated in FIG. 11

A backlight driver and an LCD including the same according to an exemplary embodiment of the present invention will be described with reference to FIGS. 11 and 12. FIG. 11 is a block diagram of an LCD 13 including first through $n^{th}$ backlight drivers 903_1 through **903_*n* according to an exemplary embodiment of the present invention. FIG. 12 is a block diagram of an $i^{th}$ backlight driver 903_*i* illustrated in FIG. 11**.

Elements having the same functions as those illustrated in FIGS. 6 and 8 are indicated by like reference numerals, and thus their description will be omitted.

Referring to FIG. 11, unlike what is shown in the previously described exemplary embodiments, in the present exemplary embodiment, a second timing controller 703 of the LCD 13 transmits a load signal LOAD to the first through $n^{th}$ backlight drivers 903_1 through **903_*n*. The first through $n^{th}$ backlight drivers 903_1 through 903_*n* receive the load signal LOAD and control the luminances of first through eightieth light-emitting blocks LB_1 through LB_80 corresponding to the first through $n^{th}$ backlight drivers 903_1 through 903_*n*, respectively, in response to input optical data. By receiving the load signal LOAD, the first through $n^{th}$ backlight drivers 903_1 through 903_*n* can simultaneously control the luminances of the first through eightieth light-emitting blocks LB_1 through LB_80 in response to the optical data. Therefore, the first through $n^{th}$ backlight drivers 903_1 through 903_*n* can control the luminances of the first through eightieth light-emitting blocks LB_1 through LB_80 at each time t1, t2, t3 or t4 as illustrated in FIGS. 10A through 10**D, respectively.

More specifically, referring to FIGS. 11 and 12, each of the first through $n^{th}$ backlight drivers 903_1 through **903_*n* includes an interface unit 911_*i*, a serial-parallel converter 941_*i*, a plurality of holding units 951_*i* through 958_*i*, a plurality of switching units SW1_*i* through SW8*i*, and a plurality of control units. The control units include a plurality of PWM generators 921_*i* through 928_*i* and a plurality of switching devices $Q_{D_1}$ through $Q_{D_8}$, respectively. For example, if the first through eightieth light-emitting blocks LB_1 through LB_80 are arranged in a 8×10 matrix, there may be ten first through $n^{th}$ backlight drivers 903_1 through 903_*n*, and there may be eight holding units 951_*i* through 958_*i* and light switching units SW1_*i* through SW8_*i***.

As described above, the serial-parallel converter **941_*i* converts optical data LDATi serially provided into parallel optical data. Then, each of the holding units 951_*i* through 958_*i* stores the parallel optical data. The switching units SW1_*i* through SW8_*i* transmit the parallel optical data to the control units, respectively, in response to the load signal LOAD. Accordingly, the control units control the luminances of the first through eightieth light-emitting blocks LB_1 through LB_80**, respectively, in response to the parallel optical data.

Because each of the first through $n^{th}$ backlight drivers 903_1 through **903_*n* includes the holding units 951_*i* through 958_*i*, the switching units SW through SW8_*i* and the control units, they can control the luminances of each of the first through eightieth light-emitting blocks LB_1 through LB_80, as illustrated in FIG. 9**.

In addition, because the second timing controller 703 transmits the load signal LOAD to each of the first through $n^{th}$ backlight drivers 903_1 through **903_*n*, the luminances of the first through eightieth light-emitting blocks LB_1 through LB_80** can be controlled in units of rows at a specified time.

In the first through $n^{th}$ backlight drivers 903_1 through **903_*n* and the LCD 13 including the same according to the exemplary embodiment shown in FIG. 11, the luminances of the first through eightieth light-emitting blocks LB_1 through LB_80 can be controlled in units of blocks or in units of rows. Furthermore, because a timing controller 803 serially provides the optical data LDATi to the first through $n^{th}$ backlight drivers 903_1 through 903_*n* through the serial bus SB, the number of wires between the timing controller 803 and the first through $n^{th}$ backlight drivers 903_1 through 903_*n*** can be reduced.

Figure 13:
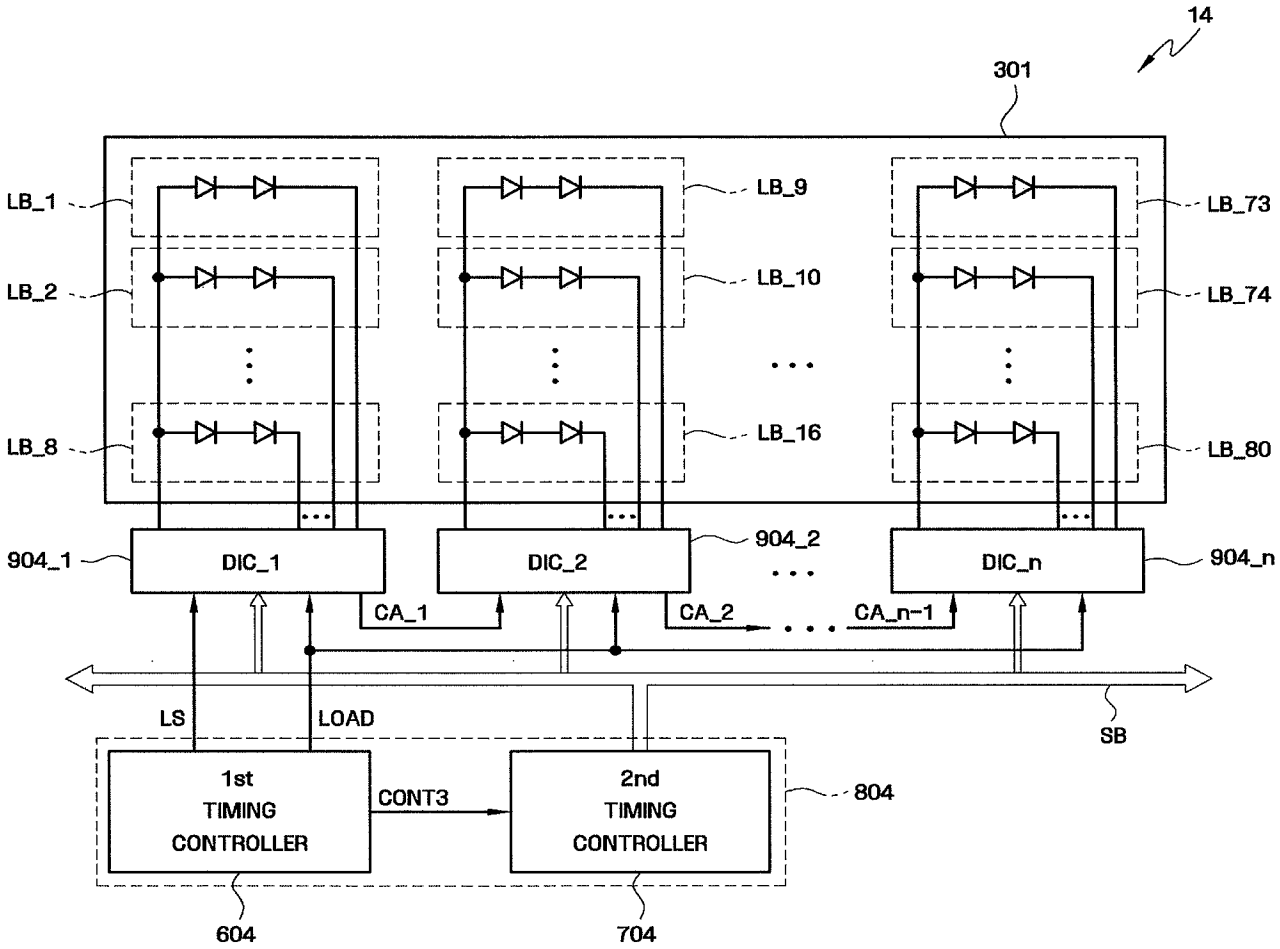
FIG. 13 is a block diagram of an LCD including first through $n^{th}$ backlight drivers according to an exemplary embodiment of the present invention.

A backlight driver and an LCD including the same according to an exemplary embodiment of the present invention will be described with reference to FIG. 13. FIG. 13 is a block diagram of an LCD 14 including first through $n^{th}$ backlight drivers 904_1 through **904_*n* according to an exemplary embodiment of the present invention. Elements having the same functions as those illustrated in FIG. 11** are indicated by like reference numerals, and thus their description will be omitted.

Referring to FIG. 13, unlike what is shown in the previously described exemplary embodiments, in the present exemplary embodiment, a first timing controller 604 of the LCD 14 transmits a start signal LS and a load signal LOAD to the first through $n^{th}$ backlight drivers 904_1 through **904_*n*. In this case, the load signal LOAD may be one of a data control signal CONT1 and a gate control signal CONT2. For example, the start signal LS may be any one of a vertical start signal for initiating the operation of the gate driver 400 of FIG. 1, a gate clock signal for determining an output time of a gate-on voltage Von, an output enable signal for determining a pulse width of the gate-on voltage Von, a horizontal start signal for initiating the operation of the data driver 500 of FIG. 1** and an output command signal for instructing the output of an image data voltage. Alternatively, the load signal LOAD may be a signal synchronized with any one of the above signals or may be a combination of the above signals. Alternatively, the load signal LOAD may be any one of a vertical synchronization signal Vsync, a horizontal synchronization signal Hsync, a main clock Mclk and a data enable signal DE, may be a signal synchronized with any one of the same, or may be a combination of the same.

Figure 14:
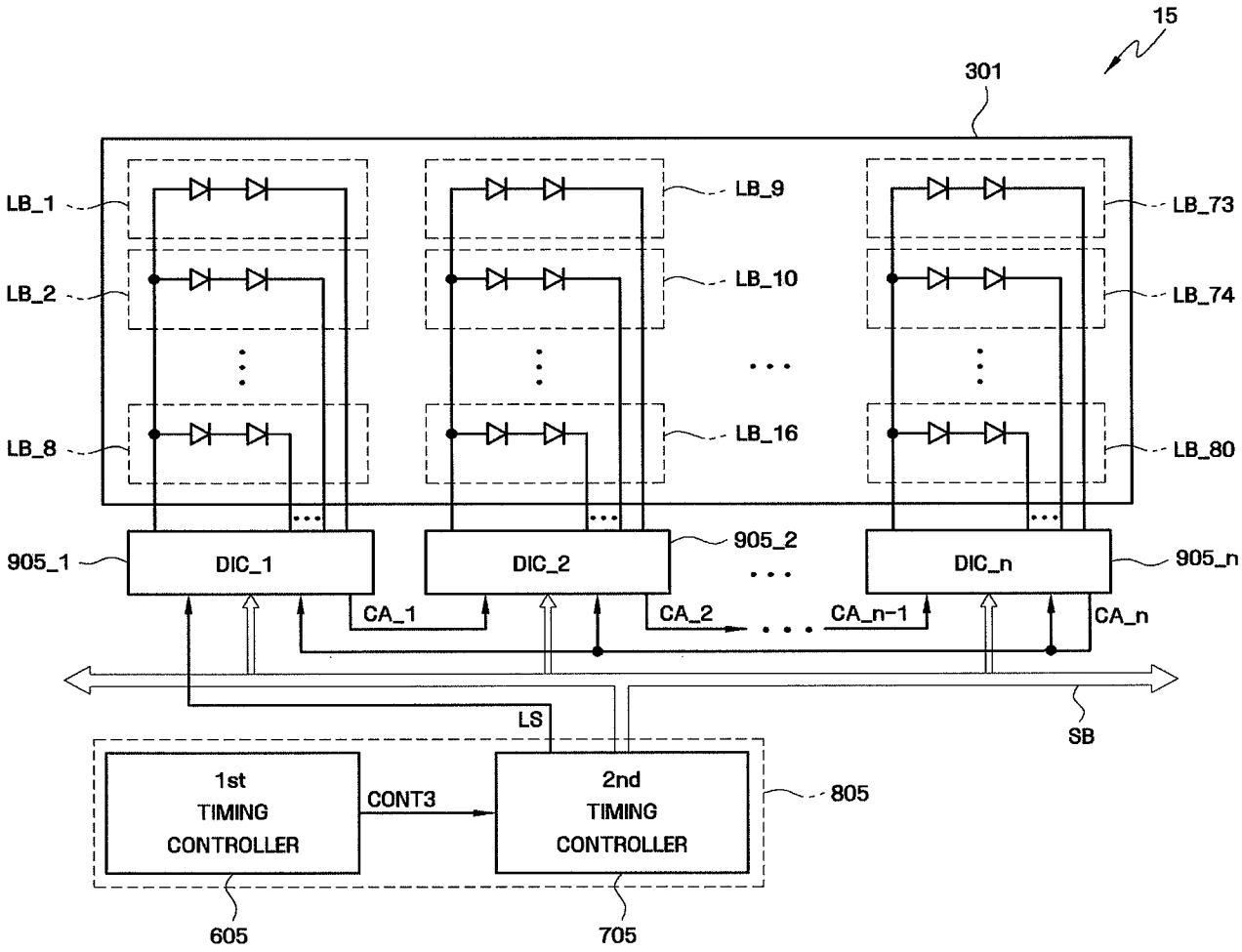
FIG. 14 is a block diagram of an LCD including first through $n^{th}$ backlight drivers according to an exemplary embodiment of the present invention.

A backlight driver and an LCD including the same according to an exemplary embodiment of the present invention will be described with reference to FIG. 14. FIG. 14 is a block diagram of an LCD 15 including first through $n^{th}$ backlight drivers 905_1 through **905_*n* according to an exemplary embodiment of the present invention. Elements having the same functions as those illustrated in FIG. 11** are indicated by like reference numerals, and thus their description will be omitted.

Referring to FIG. 14, unlike what is shown in the previously described exemplary embodiments, in the present exemplary embodiment, a load signal LOAD may be an $n^{th}$ carry signal CA_n of the $n^{th}$ backlight driver **905_*n*. More specifically, the first through $n^{th}$ backlight drivers 905_1 through 905_*n* are sequentially enabled and thus receive optical data. When the $n^{th}$ backlight driver 905_*n* is enabled and thus receives optical data, it outputs the $n^{th}$ carry signal CA_n. When the $n^{th}$ carry signal CA_n is provided to the first through $n^{th}$ backlight drivers 905_1 through 905_*n* as the load signal LOAD, the first through $n^{th}$ backlight drivers 905_1 through 905_*n* control the luminances of first through eightieth light-emitting blocks LB_1 through LB_80** in response to input optical data.

Figure 15:
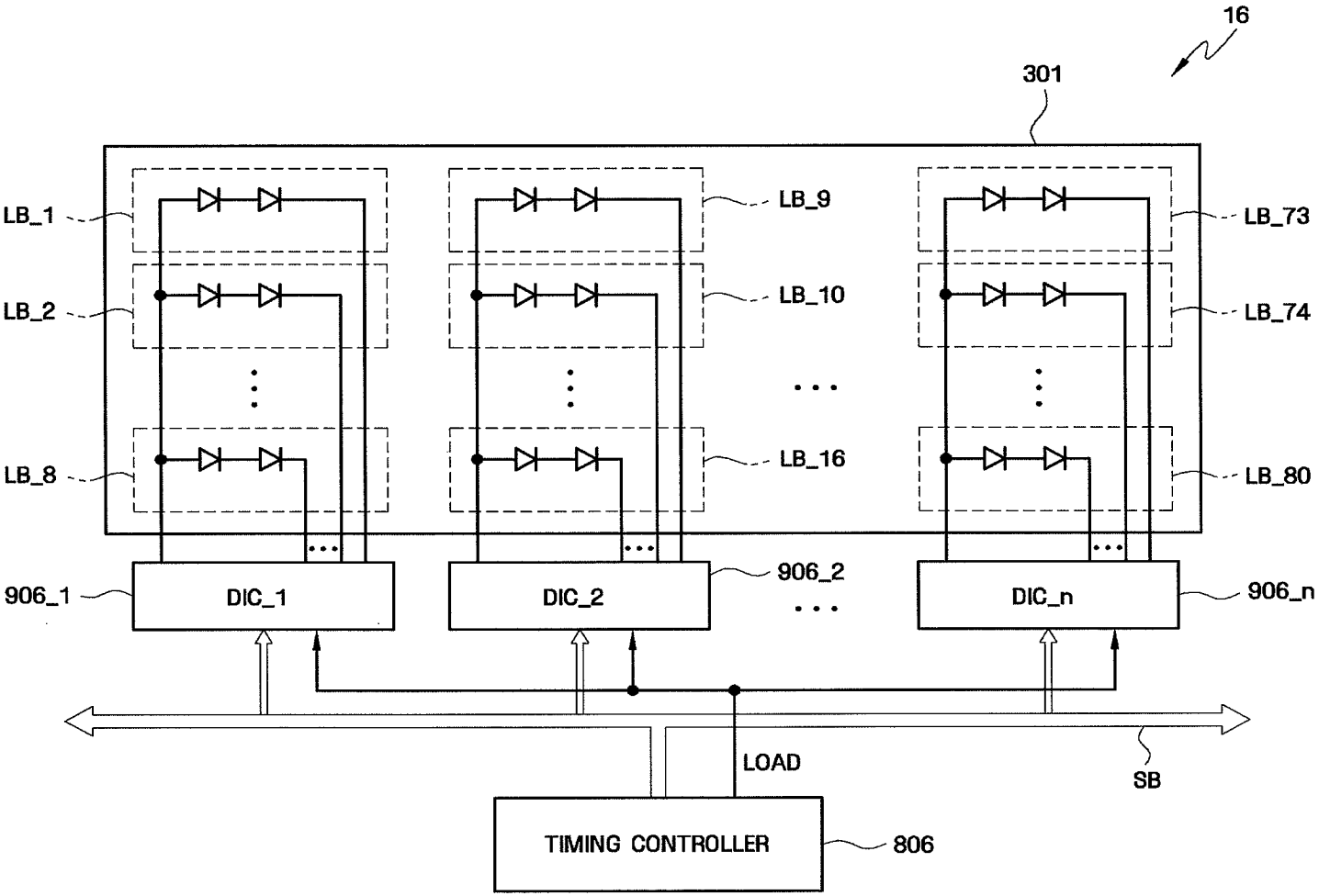
FIG. 15 is a block diagram of an LCD including first through $n^{th}$ backlight drivers according to an exemplary embodiment of the present invention.
Figure 16:
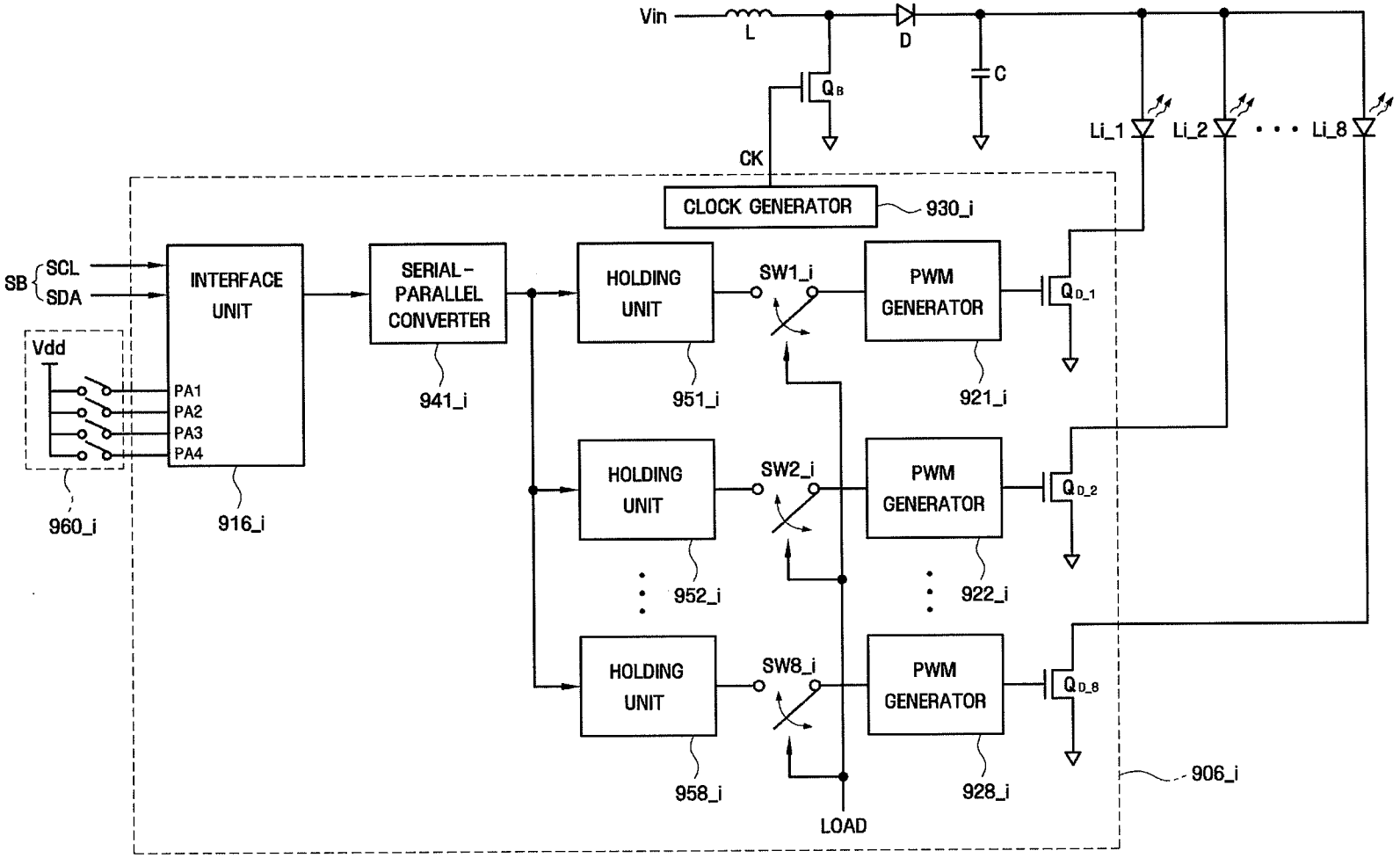
FIG. 16 is a block diagram of an $i^{th}$ backlight driver illustrated in FIG. 15.

A backlight driver and an LCD including the same according to an exemplary embodiment of the present invention will be described with reference to FIGS. 15 and 16. FIG. 15 is a block diagram of an LCD 16 including first through $n^{th}$ backlight drivers 906_1 through **906_*n* according to an exemplary embodiment of the present invention. FIG. 16 is a block diagram of an backlight driver 906_*i* illustrated in FIG. 15. Elements having the same functions as those illustrated in FIG. 11** are indicated by like reference numerals, and thus their description will be omitted.

Referring to FIG. 15, unlike what is shown in the previously described exemplary embodiments, a timing controller 806 does not transmit a start signal LS to the first backlight driver 906_1. Instead, the timing controller 806 provide an address signal and optical data to the first backlight driver 906_1 through a serial bus SB. That is, the first through $n^{th}$ backlight drivers 906_1 through **906_*n* are not enabled in response to the start signal LS or first through $(n-1)^{th}$ carry signals CA_1 through CA_n−1, respectively. Instead, the first through $n^{th}$ backlight drivers 906_1 through 906_*n* are enabled in response to corresponding address signals and receive corresponding optical data. After providing optical data to each of the first through $n^{th}$ backlight drivers 906_1 through 906_*n*, the timing controller 806 can transmit the load signal LOAD to the first through n' backlight drivers 906_1 through 906_*n*** at the same time. An address signal and optical data may be provided through a single serial bus or different serial buses. If the address signal and the optical data are provided through a single serial bus, the serial bus may be an inter-integrated circuit (I2C) bus.

Referring to FIG. 16, each backlight driver, for example, the $i^{th}$ backlight driver **906_*i*, serially interfaces with the timing controller 806 using an I2C interface method. That is, the serial bus SB includes a clock line SCL and a data line SDA, and an address signal and optical data corresponding to the $i^{th}$ backlight driver 906*i* are provided to the $i^{th}$ backlight driver 906_*i*** through the data line SDA. In addition, the address signal and the optical data are synchronized with a clock signal of the clock line SCL and transmitted accordingly. Since the I2C interface method is a well-know serial interface method, a detailed description thereof will be omitted.

The $i^{th}$ backlight driver **906_*i* includes an interface unit 916_*i* interfacing with the timing controller 806 using the I2C interface method. That is, when receiving an address signal corresponding to the $i^{th}$ backlight driver 906_*i*, the interface unit 916_*i* receives optical data that is serially transmitted. In order to perceive the address signal corresponding to the $i^{th}$ backlight driver 906_*i*, the $i^{th}$ backlight driver 906_*i* may further include an address unit 960_*i*. That is, the address unit 960_*i* provides a unique address of the $i^{th}$ backlight driver 906_*i* to the interface unit 916_*i*. The interface unit 916_*i* receives the unique address of the $i^{th}$ backlight driver 906_*i*. In addition, when receiving the address signal corresponding to the $i^{th}$ backlight driver 906_*i* through the serial bus SB, the interface unit 916_*i*** receives corresponding optical data.

The address unit **960_*i* may include a plurality of switching devices connected to a digital voltage Vdd. For example, the address unit 960_*i* may provide the unique 4-bit address of the $i^{th}$ backlight driver 906_*i* using four switching devices connected respectively to address pins PA through PA4 of the interface unit 916_*i*. The interface unit 960_*i* according to exemplary embodiments of the present invention, however, is not limited to the above example. That is, the address unit 960_*i* may also be a memory providing the unique address of the backlight driver 906_*i***.

As described above, in a backlight driver and an LCD including the same according to exemplary embodiments of the present invention, the number of wires connecting backlight drivers and a timing controller and the number of wires connecting the backlight drivers and light-emitting devices can be reduced. Accordingly, manufacturing costs of the LCD can be reduced. In addition, since problems caused by short circuits and disconnections of wires can be reduced, reliability of the LCD can be improved.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A liquid crystal display (LCD) comprising:

a timing controller;

first through n-th backlight drivers serially interfacing with the timing controller, n being an integer greater than one;

a plurality of light-emitting blocks corresponding respectively to each of the first through n-th backlight drivers, each light-emitting block including one or more light-emitting devices; and a liquid crystal panel receiving light from the plurality of light-emitting blocks and displaying an image, wherein each of the first through n-th backlight drivers controls respective luminances of the corresponding light-emitting blocks in response to a load signal simultaneously applied by the timing controller directly to each of the first through n-th backlight drivers, wherein the first through n-th backlight drivers receive optical data, and wherein an i-th backlight driver ($1<i<n$) comprises:

an interface unit enabled in response to an (i−1)-th carry signal transmitted from an (i−1)-th backlight driver, receiving the optical data, and outputting an i-th carry signal;

a serial-parallel converter converting the optical data serially input into parallel optical data;

a plurality of control units controlling the plurality of light-emitting blocks in response to the parallel optical data;

a plurality of holding units receiving the parallel optical data from the serial-parallel converter and storing the parallel optical data; and a plurality of switching units enabled in response to a load signal and transmitting the parallel optical data to the plurality of control units, respectively.

2. The LCD of claim 1, further comprising a serial bus serially transmitting the optical data output from the timing controller, wherein each of the first through n-th backlight drivers is connected to the serial bus.

3. The LCD of claim 1, wherein the first through n-th backlight drivers are connected to each other in cascade and are sequentially enabled.

4. The LCD of claim 3, wherein the first backlight driver is enabled in response to a start signal transmitted from the timing controller, receives the optical data, and outputs a first carry signal to a second backlight driver.

5. The LCD of claim 4, wherein an i-th backlight driver ($1<i<n$) is enabled in response to an (i−1)-th carry signal transmitted from an (i−1)-th backlight driver, receives the optical data, and outputs an i-th carry signal to an (i+1)-th backlight driver.

6. The LCD of claim 1, wherein the plurality of light-emitting blocks are arranged in a matrix, each of the first through n-th backlight drivers corresponds to a column of the matrix of light-emitting blocks, and the first through n-th backlight drivers control the light-emitting blocks to be turned on or off in units of rows.

* * * * *